US007007676B1

(12) United States Patent
Schuricht et al.

(10) Patent No.: US 7,007,676 B1
(45) Date of Patent: Mar. 7, 2006

(54) FUEL SYSTEM

(75) Inventors: Scott Schuricht, Edwards, IL (US); Rammohan Sankar, Peoria, IL (US); Daniel R. Puckett, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 11/045,290

(22) Filed: Jan. 31, 2005

(51) Int. Cl.
*F02M 51/00* (2006.01)

(52) U.S. Cl. ..... 123/479; 123/359

(58) Field of Classification Search ..... 123/357, 123/359, 479, 456, 494, 500, 501; 73/119 A; 701/114
See application file for complete search history.

(56) References Cited

U.S. PATENT DOCUMENTS

| | | | | |
|---|---|---|---|---|
| 4,541,380 | A | 9/1985 | Oshizawa et al. | |
| 4,704,685 | A | 11/1987 | Martinsons et al. | |
| 4,793,308 | A | 12/1988 | Bräuninger et al. | |
| 5,293,852 | A | 3/1994 | Lehner et al. | |
| 5,388,562 | A | 2/1995 | Sekiguchi et al. | |
| 5,499,538 | A * | 3/1996 | Glidewell et al. | 73/119 A |
| 5,653,210 | A * | 8/1997 | Fischer et al. | 123/501 |
| 5,937,826 | A | 8/1999 | Olson et al. | |
| 6,024,064 | A | 2/2000 | Kato et al. | |
| 6,032,639 | A * | 3/2000 | Goto et al. | 123/295 |
| 6,053,147 | A | 4/2000 | Hemmerlein et al. | |
| 6,209,521 | B1 | 4/2001 | Rembold et al. | |
| 6,293,251 | B1 | 9/2001 | Hemmerlein et al. | |
| 6,474,306 | B1 * | 11/2002 | Muller et al. | 123/479 |
| 6,578,555 | B1 | 6/2003 | Sykes | |
| 6,644,284 | B1 | 11/2003 | Pfitz | |
| 6,694,953 | B1 | 2/2004 | Barnes et al. | |
| 6,712,047 | B1 | 3/2004 | Rueger | |
| 6,840,224 | B1 * | 1/2005 | Tanabe et al. | 123/458 |
| 2003/0226399 | A1 * | 12/2003 | Clingerman et al. | 73/119 A |
| 2004/0002810 | A1 * | 1/2004 | Akuzawa et al. | 701/114 |
| 2004/0249555 | A1 | 12/2004 | Doelker | |

FOREIGN PATENT DOCUMENTS

| | | |
|---|---|---|
| DE | 102 54 464 A1 | 11/2002 |
| JP | 2002339787 | 11/2002 |
| JP | 2003222045 | 8/2003 |

* cited by examiner

*Primary Examiner*—Carl S. Miller
(74) *Attorney, Agent, or Firm*—Finnegan,Henderson,Farabow,Garrett & Dunner

(57) ABSTRACT

A fuel system for an engine has a source of pressurized fuel, a rail, and a plurality of fuel injectors. The fuel system also has a sensor to sense a parameter of the pressurized fuel, and a controller. The controller is configured to generate a flow control offset value indicative of a difference between the value of the parameter and a desired value for the parameter, and to control operation of the source in response to the flow control offset value when the sensor is determined to be functioning properly. The controller is also configured to store the flow control offset value in a memory of the controller when the sensor is determined to be functioning properly and to associate the flow control offset value with at least one operating condition of the engine. The controller is further configured to control operation of the source in response to previously stored flow control offset value when the sensor is determined to be malfunctioning.

21 Claims, 2 Drawing Sheets

FUEL SYSTEM

TECHNICAL FIELD

The present disclosure is directed to a fuel system and, more particularly, to a fuel system having a sensor failure strategy.

BACKGROUND

Common rail fuel systems typically employ multiple fuel injectors connected to a common rail that is provided with high pressure fuel. These fuel injectors can be selectively actuated to inject precise quantities of fuel at precise timings into combustion chambers of an associated engine. In order to produce these precise injection events, it can be important to know the pressure of the fuel within the common rail just prior to the injection events. For example, the fuel pressure within the common rail can drive displacement and/or delivery control of an associated fuel pump to provide fuel flow sufficient for the injection event. Fuel pressure information can also be used to calculate an injection timing and an injection duration that results in the desired injection event. This fuel pressure information may be provided by a pressure sensor associated with the common rail.

During operation of the common rail fuel system, it is possible for the pressure sensor to fail or malfunction. Without a backup strategy in place to drive pump output and determine injection timing and duration, the engine could be rendered inoperable. In order to ensure that the engine remains at least somewhat operable in the event of pressure sensor failure, a backup strategy may be implemented that provides some continued operational capability (e.g., engine operation allowing minimal propulsion, steering, braking, etc.). One such system is described in U.S. Pat. No. 6,024,064 (the '064 patent) issued to Kato et al. on Feb. 15, 2000. The '064 patent describes a fuel system having a pressure sensor for sensing the fuel pressure in a common rail. When the pressure sensor fails, an associated high pressure fuel supply pump and/or injectors may be controlled in several different ways without depending on signals from the pressure sensor to provide a "limp-home" function. The first way includes monitoring engine speed and load, and controlling the high pressure fuel supply pump according to a 2-dimensional (2-D) map. The 2-D map is factory preset into a control unit and shows a required fuel pressure for each set of an engine speed and load. Fuel injection timing and pulse width (duration) are calculated according to engine speed and load. The second way includes operating the high pressure fuel supply pump at a fixed output and controlling only fuel injection and pulse width according to engine speed and load. The third way includes operating the high pressure pump at maximum output and controlling injection and pulse width under assumed maximum pressure conditions.

Although the fuel system of the '064 patent may provide some continued engine operational capability, it may be inefficient and potentially damaging to the engine employing the fuel system. In particular, the components of the fuel system and associated engine wear over time, and settings that may have been appropriate when tested on a new engine under lab conditions may not be appropriate for an older engine under field conditions. Further, the fuel system of the '064 patent does not limit injector performance that could potentially damage the associated engine during conditions of pressure sensor failure.

The fuel system of the present disclosure solves one or more of the problems set forth above.

SUMMARY OF THE INVENTION

One aspect of the present disclosure is directed to a fuel system for an engine. The fuel system includes a source of pressurized fuel, a rail configured to receive the pressurized fuel, and a plurality of fuel injectors in parallel fluid communication with the rail. The fuel system also includes a sensor configured to sense a parameter of the pressurized fuel within the rail and to generate a signal corresponding to the value of the parameter. The fuel system further includes a controller in communication with the engine, the source of pressurized fuel, and the sensor. The controller is configured to generate a flow control offset value indicative of a difference between the value of the parameter and a desired value for the parameter, and to control operation of the source in response to the flow control offset value. The controller is also configured to store the flow control offset value in a memory of the controller when it is determined that the sensor is functioning properly, and to associate the flow control offset value with at least one operating condition of the engine. The controller is further configured to control operation of the source in response to a previously stored flow control offset value when the sensor is determined to be malfunctioning.

Another aspect of the present disclosure is directed to a method of operating a fuel system for an engine. The method includes pressurizing a supply of fuel and directing the pressurized fuel to a plurality of fuel injectors via a common rail. The method further includes sensing a parameter of the pressurized fuel within the common rail with a sensor associated with the common rail and generating a flow control offset value indicative of a difference between the value of the parameter and a desired value for the parameter. The method also includes controlling operation of a source of the pressurized fuel in response to the flow control offset value when the sensor is determined to be functioning properly. The method additionally includes storing the flow control offset value in a memory of the controller when the sensor is determined to be functioning properly and associating the flow control offset value with at least one operating condition of the engine. The method further includes controlling operation of the source in response to a previously stored flow control offset value when the sensor is determined to be malfunctioning.

DETAILED DESCRIPTION

Figure 1:
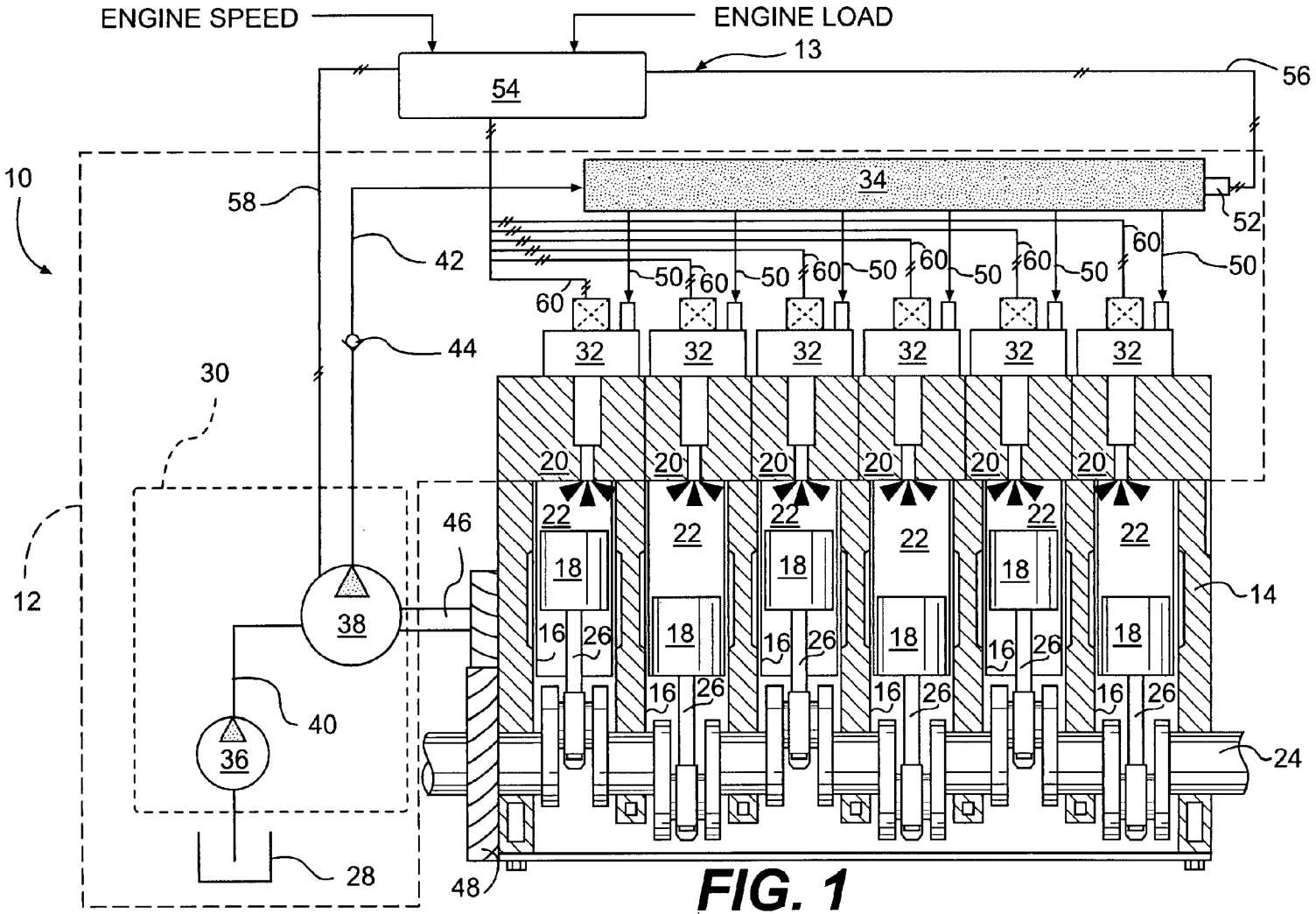
FIG. 1 is a schematic and diagrammatic illustration of an exemplary disclosed fuel system.

An exemplary embodiment of an engine 10 having a fuel system 12 and a control system 13 is illustrated in FIG. 1. For the purposes of this disclosure, engine 10 is depicted and described as a four-stroke diesel engine, having a typical cycle consisting of an intake stroke, a compression stroke, a power stroke, and an exhaust stroke. One skilled in the art will recognize, however, that engine 10 may be any other type of internal combustion engine such as, for example, a gasoline engine. Engine 10 may include an engine block 14 that defines a plurality of cylinders 16, a piston 18 slidably disposed within each cylinder 16, and a cylinder head 20 associated with each cylinder 16.

Cylinder 16, piston 18, and cylinder head 20 may form a combustion chamber 22. In the illustrated embodiment, engine 10 includes six combustion chambers 22. However, it is contemplated that engine 10 may include a greater or lesser number of combustion chambers 22 and that combustion chambers 22 may be disposed in an "in-line" configuration, a "V" configuration, or any other suitable configuration.

As also shown in FIG. 1, engine 10 may include a crankshaft 24 that is rotatably disposed within engine block 14. A connecting rod 26 may connect each piston 18 to crankshaft 24 so that a sliding motion of piston 18 within each respective cylinder 16 results in a rotation of crankshaft 24. Similarly, a rotation of crankshaft 24 may result in a sliding motion of piston 18.

Fuel system 12 includes components that cooperate to deliver injections of pressurized fuel into each combustion chamber 22. Specifically, fuel system 12 may include a tank 28 configured to hold a supply of fuel, and a fuel pumping arrangement 30 configured to pressurize the fuel and direct the pressurized fuel to a plurality of fuel injectors 32 by way of a common rail 34.

Fuel pumping arrangement 30 may include one or more pumping devices that function to increase the pressure of the fuel and direct one or more pressurized streams of fuel to common rail 34. In one example, fuel pumping arrangement 30 includes a low pressure source 36 and a high pressure source 38 disposed in series and fluidly connected by way of a fuel line 40. Low pressure source 36 may be a transfer pump configured to provide low pressure feed to high pressure source 38. High pressure source 38 may be configured to receive the low pressure feed and to increase the pressure of the fuel to the range of about 40–190 MPa. High pressure source 38 may be connected to common rail 34 by way of a fuel line 42. A check valve 44 may be disposed within fuel line 42 to provide for one-directional flow of fuel from fuel pumping arrangement 30 to common rail 34.

Both of low pressure and high pressure sources 36, 38 may each be any suitable type of pump known in the art. For example, low and high pressure sources 36, 38 may each embody a fixed displacement pump having a movable sleeve that meters pressurized fuel from one or more axial pistons, a variable displacement pump having a swash plate that is angularly oriented to control output, a fixed delivery pump having a pressure control valve, or any other appropriate type of pump.

One or both of low pressure and high pressure sources 36, 38 may be operably connected to engine 10 and driven by crankshaft 24. Low and/or high pressure sources 36, 38 may be connected with crankshaft 24 in any manner readily apparent to one skilled in the art where a rotation of crankshaft 24 will result in a corresponding rotation of a pump drive shaft. For example, a pump driveshaft 46 of high pressure source 38 is shown in FIG. 1 as being connected to crankshaft 24 through a gear train 48. It is contemplated, however, that one or both of low and high pressure sources 36, 38 may alternatively be driven electrically, hydraulically, pneumatically, or in any other appropriate manner.

Fuel injectors 32 may be disposed within cylinder heads 20 and connected to common rail 34 by way of a plurality of fuel lines 50. Each fuel injector 32 may be operable to inject an amount of pressurized fuel into an associated combustion chamber 22 at predetermined timings, fuel pressures, and fuel flow rates. It is contemplated that fuel injectors 32 may be hydraulically operated, mechanically operated, electrically operated, pneumatically operated, or operated in any other suitable manner.

The timing of fuel injection into combustion chamber 22 may be synchronized with the motion of piston 18. For example, fuel may be injected as piston 18 nears a top-dead-center position in a compression stroke to allow for compression-ignited-combustion of the injected fuel. Alternatively, fuel may be injected as piston 18 begins the compression stroke heading towards a top-dead-center position for homogenous charge compression ignition operation. Fuel may also be injected as piston 18 is moving from a top-dead-center position towards a bottom-dead-center position during an expansion stroke for a late post injection to create a reducing atmosphere for aftertreatment regeneration.

Control system 13 may include components that cooperate to control operation of high pressure source 38 and/or fuel injectors 32 in response to one or more inputs. In particular, control system 13 may include a sensor 52 operably associated with common rail 34, and a controller 54.

Sensor 52 may be a pressure sensor configured to sense a pressure of the fuel within common rail 34 and to generate a signal indicative of the pressure. It is contemplated that sensor 52 may alternately sense a different or additional parameter of the fuel within common rail 34 such as, for example, a temperature, a viscosity, a flow rate, or any other parameter known in the art.

Controller 54 may be embodied in a single microprocessor or multiple microprocessors that include a means for controlling an operation of fuel system 12. Numerous commercially available microprocessors can be configured to perform the functions of controller 54. It should be appreciated that controller 54 could readily be embodied in a general engine microprocessor capable of controlling numerous engine functions. Controller 54 may include a memory, a secondary storage device, a processor, and other components for running an application. Various other circuits may be associated with controller 54 such as power supply circuitry, signal conditioning circuitry, solenoid driver circuitry, and other types of circuitry.

Controller 54 may be configured to receive the signal generated by sensor 52 and to create a flow control offset value. In particular, controller 54 may be in communication with sensor 52 via a communication line 56 to receive the signal from sensor 52. Controller 54 may compare the signal to a desired pressure value that is necessary for a desired injection event, and create the flow control offset value indicative of the difference.

The flow control offset values may be stored in the memory of controller 54. Specifically, as controller 54 creates flow control offset values corresponding to particular engine speeds and engine loads, controller 54 may store these flow control offset values in a two dimensional table or map located within the memory of controller 54. One axis of the table or map may correspond to engine load while the other axis may correspond to engine speed. Engine load may be determined by monitoring a fuel setting, an accelerator position, a throttle position, or in any other manner known in the art. Because components within engine 10 and fuel system 12 wear over time, it may be necessary to update the table with new values in order to ensure accurate injections. Controller 54 may update the flow control offset values within the table after each injection event or, alternatively, may periodically update the flow control offset values according to a predetermined schedule.

Controller 54 may be further configured to control an output of high pressure source 38. In particular, controller 54 may be in communication with high pressure source 38 via a communication line 58. Controller 54 may be configured to predict injector fuel consumption for the desired injection event, sum this prediction with the flow control offset value described above, and control high pressure source 38 in response to the summation to produce a fuel flow sufficient for the desired injection event.

Controller 54 may also be configured to control an output of high pressure source 38 without relying on a current rail pressure measurement. In particular, during failure conditions of sensor 52, controller 54 may reference a current engine speed and load with the table stored in the memory of controller 54 to use a previously stored flow control offset value instead of a flow control offset value based on current rail pressure. Current engine speed and load values may be provided by a general engine controller (not shown) or, alternatively, may be measured directly by way of a speed sensor (not shown) and by monitoring a fuel rack or accelerator setting, respectively.

Controller 54 may also be configured to control fuel injectors 32. For example, controller 54 may be in communication with fuel injectors 32 via communication lines 60. Controller 54 may be configured to calculate and implement a fuel injection timing and/or a fuel injection duration based on the measured rail fuel pressure or, alternatively based on a predetermined constant pressure value in the event of pressure sensor failure. It is contemplated that controller 54 may alternatively calculate and implement fuel injection timing and/or fuel injection duration based on a desired fuel pressure and the flow control offset value described previously when sensor 52 is determined to be malfunctioning. Controller 54 may be further configured to limit fuel injectors 32 to a single injection during a complete cycle of an associated piston 18 when sensor 52 has failed or is malfunctioning.

Figure 2:
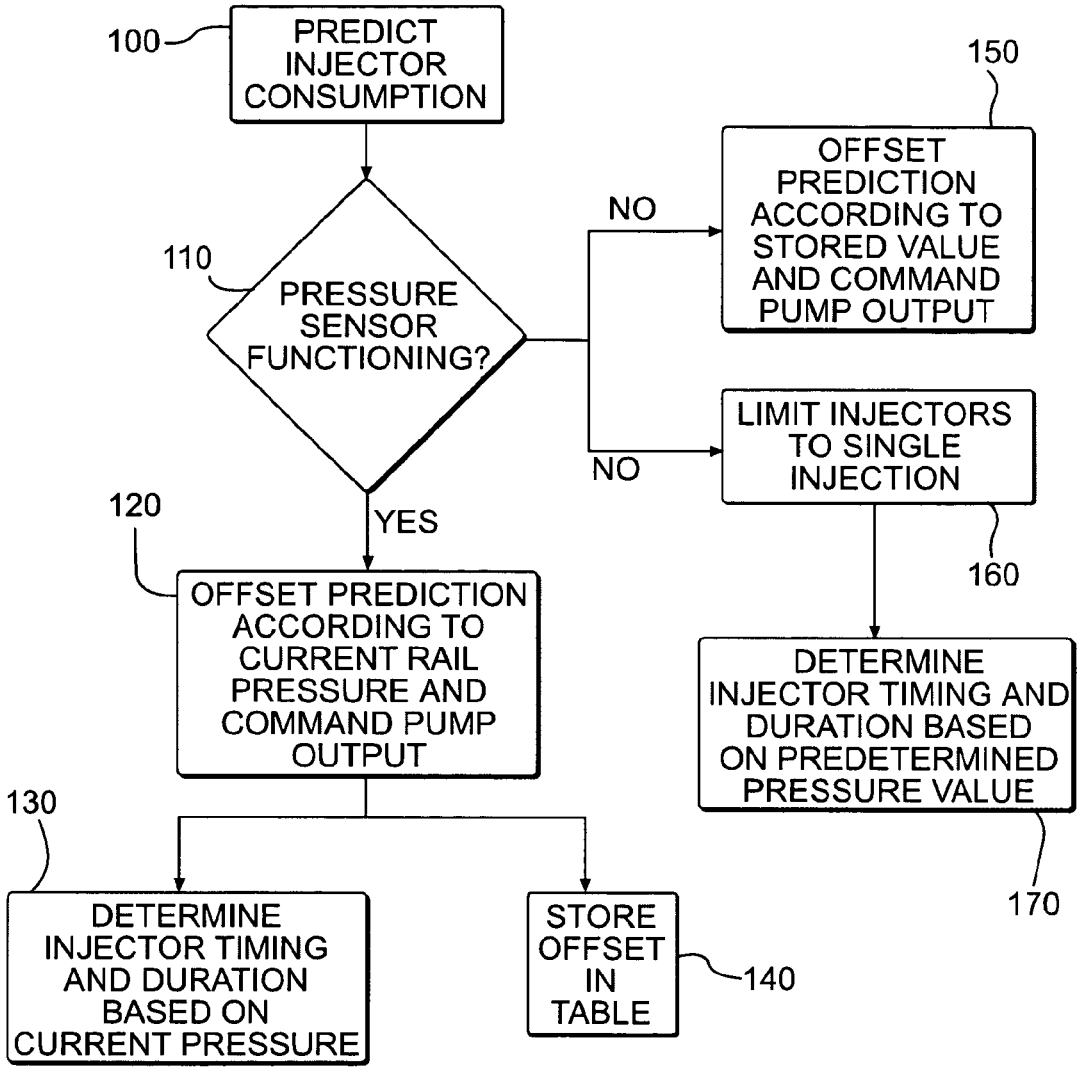
FIG. 2 is a flow chart illustrating an exemplary disclosed method of operating the fuel system of FIG. 1.

FIG. 2 illustrates an exemplary method of operating fuel system 12. FIG. 2 will be described in detail in the following section.

INDUSTRIAL APPLICABILITY

The fuel system of the present disclosure has wide applications in a variety of engine types including, for example, diesel engines and gasoline engines. The disclosed invention may be implemented into any engine that utilizes a pressurizing fuel system having common rail fuel injectors where knowing the pressure of the fuel in the common rail is important for controlling operation of the fuel system. Fuel system 12 will now be explained.

As illustrated in FIG. 2, implementing a desired injection begins with controller 54 predicting an amount of fuel that will be by fuel injectors 32 during the anticipated injection event (step 100). Controller 54 may then determine whether or not sensor 52 is functioning properly (step 110) and offset the predicted fuel consumption in one of two ways. Controller 54 may determine that sensor 52 is malfunctioning if a measured pressure value is outside of a predetermined range of values for a predetermined number of samples, or if controller 54 determines a shorted conditions or loss of communications. It is contemplated that the step of determining functionality of sensor 52 may be ordered differently such as, for example, before step 100.

If controller 54 determines that sensor 52 is functioning properly, controller 54 may create the flow control offset value by comparing a sensed current rail pressure with a desired rail pressure. This flow control offset value may then be added to the predicted fuel consumption amount and the output of high pressure source 38 appropriately increased or decreased (step 120).

Similarly, after controller 54 has determined that sensor 52 is functioning properly, controller 54 may calculate and implement an injection timing and duration based on the current pressure of fuel within common rail 34 that results in the desired injection and subsequent combustion events (step 130). Controller 54 may then store the flow control offset value in the appropriate position within the memory of controller 54 that corresponds to the current speed and load conditions of engine 10 (step 140).

However, if controller 54 determines that sensor 52 is malfunctioning, instead of proceeding to step 120, controller 54 may implement a sensor failure strategy that allows engine 10 some level of continued operational capacity. When operating under the sensor failure strategy, instead of using a flow control offset value calculated from a potentially erroneous pressure measurement of malfunctioning sensor 52, controller 54 may retrieve a previously-stored flow control offset value from the controller's memory that corresponds with the current speed and load conditions of engine 10. This previously stored flow control offset value may then be used to offset the fuel consumption prediction for proper output control of high pressure source 38 (step 150). Simultaneously, controller 54 may limit fuel injectors 32 to a single injection per piston cycle (step 160) to minimize potential damage to engine 10 resulting from the pressure sensor failure. It is also contemplated that controller 54 may limit a power output of engine 10 if failure of sensor 52 has been determined.

Under the sensor failure strategy, because an accurate measurement of the current pressure is not available, controller 54 may instead calculate and implement an injection timing and duration based on a predetermined constant pressure value (step 170). This predetermined pressure value may be set during manufacture of engine 10 and based on appropriate analysis, lab, and/or field testing that results in sufficient operational capacity of engine 10. As described above, injection timing and duration may alternatively be calculated based on a desired pressure and the stored flow control offset value that corresponds to the current speed and load conditions of engine 10.

Numerous advantages of fuel system 12 may be realized over the prior art. In particular, because fuel injection is greatly influenced by the pressure of the fuel within common rail 34, accurately knowing the pressure of the fuel prior to injection is important to achieving an accurate and precise fuel injection. By implementing a sensor failure strategy that utilizes continuously updated flow control offset values specific to a particular engine, fuel system 12 is ensured a more accurate fuel consumption prediction and corresponding output control of high pressure source 38, as compared to a factory calibrated flow control offset value. Further, because fuel system 12 limits fuel injectors 32 to a single injection per piston cycle during conditions of pressure sensor failure, potential damage to engine 10 may be minimized.

It will be apparent to those skilled in the art that various modifications and variations can be made to the fuel system of the present disclosure without departing from the scope of the disclosure. Other embodiments will be apparent to those skilled in the art from consideration of the specification and practice of the fuel system disclosed herein. It is intended that the specification and examples be considered as exemplary only, with a true scope of the invention being indicated by the following claims and their equivalents.

What is claimed is:

1. A fuel system for an engine, comprising:

a source of pressurized fuel;

a rail configured to receive the pressurized fuel;

a plurality of fuel injectors in parallel fluid communication with the rail;

a sensor configured to sense a parameter of the pressurized fuel within the rail and to generate a signal corresponding to the value of the parameter; and a controller in communication with the engine, the source of pressurized fuel, and the sensor, the controller being configured to:

generate a flow control offset value indicative of a difference between the value of the parameter and a desired value for the parameter;

control operation of the source in response to the flow control offset value when the sensor is determined to be functioning properly;

store the flow control offset value in a memory of the controller when the sensor is determined to be functioning properly and associate the stored flow control offset value with at least one operating condition of the engine; and control operation of the source in response to previously stored flow control offset values when the sensor is determined to be malfunctioning.

2. The fuel system of claim 1, wherein the at least one operating condition is a first operating condition and the controller is configured to further associate the stored flow control offset value with a second operating condition of the engine.

3. The fuel system of claim 2, wherein the first and second operating conditions of the engine include engine speed and engine load.

4. The fuel system of claim 1, wherein the parameter is pressure.

5. The fuel system of claim 1, wherein the controller is further configured to control at least one of injection duration and injection timing of the plurality of fuel injectors based on the signal from the sensor when the sensor is determined to be functioning properly and to control the at least one of injection duration and injection timing for the plurality of fuel injectors based on a predetermined value for the parameter when the sensor is determined to be malfunctioning.

6. The fuel system of claim 1, wherein the controller is further configured to control at least one of injection duration and injection timing of the plurality of fuel injectors based on the signal from the sensor when the sensor is determined to be functioning properly and to control the at least one of injection duration and injection timing for the plurality of fuel injectors based on a previously stored flow control offset value and the desired value for the parameter when the sensor is determined to be malfunctioning.

7. The fuel system of claim 1, wherein:

the engine includes a plurality of pistons, each of the plurality of pistons being movable through an intake stroke, a compression stroke, a power stroke, and an exhaust stroke to complete a cycle; and the controller is configured to limit each of the plurality of fuel injectors to a single injection per cycle of an associated one of the plurality of pistons when the sensor is determined to be malfunctioning.

8. The fuel system of claim 1, wherein the controller is configured to predict a fuel consumption amount of an impending injection event and to control operation of the source in further response to the prediction.

9. A method of operating a fuel system for an engine, the method comprising:

pressurizing a supply of fuel and directing the pressurized fuel to a plurality of fuel injectors via a common rail;

sensing a parameter of the pressurized fuel within the common rail with a sensor associated with the common rail;

generating a flow control offset value indicative of a difference between the value of the parameter and a desired value for the parameter;

controlling operation of a source of the pressurized fuel in response to the flow control offset value when the sensor is determined to be functioning properly;

storing the flow control offset value in a memory of the fuel system when the sensor is determined to be functioning properly and associating the stored flow control offset value with at least one operating condition of the engine; and controlling operation of the source of the pressurized fuel in response to previously stored flow control offset values when the sensor is determined to be malfunctioning.

10. The method of claim 9, wherein the at least one operating condition is a first operating condition and the method further includes associating the stored flow control offset value with a second operating condition of the engine.

11. The method of claim 10, wherein the first and second operating conditions include engine speed and engine load.

12. The method of claim 9, wherein the parameter is pressure.

13. The method of claim 9, further including:

controlling at least one of injection duration and injection timing of the plurality of fuel injectors based on the value of the sensed parameter when the sensor is determined to be functioning properly; and controlling the at least one of injection duration and injection timing of the plurality of fuel injectors based on a predetermined value for the parameter when the sensor is determined to be malfunctioning.

14. The method of claim 9, further including:

controlling at least one of injection duration and injection timing of the plurality of fuel injectors based on the value of the sensed parameter when the sensor is determined to be functioning properly; and controlling the at least one of injection duration and injection timing of the plurality of fuel injectors based on a previously stored flow control offset value and the desired value for the parameter when the sensor is determined to be malfunctioning.

15. The method of claim 9, wherein the engine includes a plurality of pistons, each of the plurality of pistons being movable through an intake stroke, a compression stroke, a power stroke, and an exhaust stroke to complete a cycle, and the method further includes limiting each of the plurality of fuel injectors to a single injection per cycle of an associated one of the plurality of pistons when the sensor is determined to be malfunctioning.

16. The method of claim 9, further including:

predicting a fuel consumption amount of an impending injection event; and controlling operation of the source in further response to the prediction.

17. An engine, comprising:

an engine block forming a plurality of cylinders;

a plurality of pistons disposed within the plurality of cylinders to form a plurality of combustion chambers; and a fuel system configured to inject pressurized fuel into the plurality of combustion chambers, the fuel system including:

a source of pressurized fuel;

a rail configured to receive the pressurized fuel;

a plurality of fuel injectors in parallel fluid communication with the rail;

a sensor configured to sense a pressure of the pressurized fuel within the rail and to generate a signal corresponding to the value of the pressure; and a controller in communication with the engine, the source of pressurized fuel, and the sensor, the controller being configured to:

generate a flow control offset value indicative of a difference between the sensed pressure value and a desired pressure value;

control operation of the source in response to the flow control offset value when the sensor is determined to be functioning properly;

store the flow control offset value in a memory of the controller when the sensor is determined to be functioning properly and associate the stored flow control offset value with the current speed and load of the engine; and control operation of the source in response to previously stored flow control offset values when the sensor is determined to be malfunctioning.

18. The engine of claim 17, wherein the controller is further configured to control at least one of injection duration and injection timing of the plurality of fuel injectors based on the sensed pressure when the sensor is determined to be functioning properly and to control the at least one of injection duration and injection timing for the plurality of fuel injectors based on a predetermined pressure value when the sensor is determined to be malfunctioning.

19. The engine of claim 17, wherein the controller is further configured to control at least one of injection duration and injection timing of the plurality of fuel injectors based on the sensed pressure when the sensor is determined to be functioning properly and to control the at least one of injection duration and injection timing for the plurality of fuel injectors based on a previously stored flow control offset value and the desired pressure value when the sensor is determined to be malfunctioning.

20. The engine of claim 17, wherein:

the engine includes a plurality of pistons, each of the plurality of pistons being movable through an intake stroke, a compression stroke, a power stroke, and an exhaust stroke to complete a cycle; and the controller is configured to limit each of the plurality of fuel injectors to a single injection per cycle of an associated one of the plurality of pistons when the sensor is determined to be malfunctioning.

21. The engine of claim 17, wherein the controller is configured to predict a fuel consumption amount of an impending injection event and to control operation of the source in further response to the prediction.

* * * * *